US007431755B2

(12) United States Patent
Kobayashi et al.

(10) Patent No.: US 7,431,755 B2
(45) Date of Patent: Oct. 7, 2008

(54) DUST-COLLECTING ELECTRODE AND DUST COLLECTOR

(75) Inventors: Naoki Kobayashi, Nagoya (JP); Yasumasa Fujioka, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 11/907,802

(22) Filed: Oct. 17, 2007

(65) Prior Publication Data

US 2008/0047434 A1 Feb. 28, 2008

Related U.S. Application Data

(63) Continuation of application No. PCT/JP2006/326149, filed on Dec. 27, 2006.

(30) Foreign Application Priority Data

Dec. 28, 2005 (JP) ..... 2005-377339

(51) Int. Cl.
*B03C 3/47* (2006.01)
*B03C 3/62* (2006.01)

(52) U.S. Cl. ..... 96/69; 96/73; 96/86; 96/87; 96/99

(58) Field of Classification Search ..... 96/69, 96/73, 86, 87, 95–100
See application file for complete search history.

(56) References Cited

U.S. PATENT DOCUMENTS 4,477,268 A * 10/1984 Kalt ..... 96/99
5,055,118 A * 10/1991 Nagoshi et al. ..... 96/88
5,466,279 A * 11/1995 Hattori et al. ..... 96/69
5,578,112 A * 11/1996 Krause ..... 96/24
6,056,808 A * 5/2000 Krause ..... 96/24
6,251,171 B1 * 6/2001 Marra et al. ..... 96/69
6,773,488 B2 * 8/2004 Potter ..... 95/59
7,077,890 B2 * 7/2006 Botvinnik ..... 96/69
7,160,365 B2 * 1/2007 Iwamatsu ..... 96/88
7,254,006 B2 8/2007 Sekoguchi et al.
7,261,767 B2 * 8/2007 Choi et al. ..... 96/69
7,294,176 B2 * 11/2007 Kim et al. ..... 96/69

(Continued)

FOREIGN PATENT DOCUMENTS

JP U 05-090878 12/1993

(Continued)

OTHER PUBLICATIONS

Tell et al., "Plasma Gas Phase Reaction Engineering", Uchida Rokakuho, p. 106-109, Apr. 28, 2004.

*Primary Examiner*—Richard L Chiesa
(74) *Attorney, Agent, or Firm*—Oliff & Berridge, PLC

(57) ABSTRACT

A dust-collecting electrode where at least one unit electrode between the unit electrodes facing each other includes: a ceramic dielectric body, a surface conductor disposed so as to cover at least a part of the surface of the ceramic dielectric body on the side where the unit electrodes face each other, and an internal conductive layer disposed inside the ceramic dielectric body and being electrically independent of the surface conductor. The dust-collecting electrode being capable of generating an electric field and silent discharge between the unit electrodes by applying voltage between the surface conductor of the one unit electrode and the other unit electrode and generating creeping discharge on the surface of the one unit electrode by applying voltage via the ceramic dielectric body.

12 Claims, 6 Drawing Sheets

U.S. PATENT DOCUMENTS

| | | | | |
|---|---|---|---|---|
| 2004/0201946 | A1* | 10/2004 | Iwamatsu | 361/230 |
| 2004/0226448 | A1* | 11/2004 | Griffiths et al. | 96/67 |
| 2005/0051028 | A1* | 3/2005 | Botvinnik | 96/88 |
| 2006/0000359 | A1* | 1/2006 | Choi et al. | 96/63 |
| 2006/0056129 | A1* | 3/2006 | Kim et al. | 361/230 |

FOREIGN PATENT DOCUMENTS

| | | |
|---|---|---|
| JP | A 2003-047651 | 2/2003 |
| JP | A 2005-320895 | 11/2005 |

* cited by examiner

PRIOR ART

DUST-COLLECTING ELECTRODE AND DUST COLLECTOR

TECHNICAL FIELD

The present invention relates to a dust-collecting electrode and a dust collector. More specifically, the present invention relates to a dust-collecting electrode capable of generating an electric field and silent discharge between the unit electrodes facing each other and generating creeping discharge on the surface of at least one unit electrode, and a dust collector using the dust-collecting electrode.

BACKGROUND ART a filter or an electric dust collector has conventionally been used for removing dust contained in exhaust gas discharged from an incinerator or the like. When a filter is used, it is necessary to periodically conduct back wash because the filter is clogged, and there is a drawback of an increased size of the apparatus in order to conduct a continuous treatment. When an electric dust collector is used, there is a drawback of causing re-dispersion phenomenon when fine powdery dust having low electric resistance is collected, thereby inhibiting dust collection efficiency from rising. To make up for the drawbacks, a dust collector where electrostatic dust collection and silent discharge are combined with each other is considered.

As a dust-collecting electrode (sometimes referred to as a "discharge electrode") used for a dust collector where an electrostatic dust collection and silent discharge are combined with each other, it is noted that a dust-collecting electrode is provided with two unit electrodes where both ends of the unit electrodes are fixed and a dielectric body disposed between the unit electrodes. In a dust-collecting electrode constituted in such a manner, silent discharge is generated between the unit electrodes by applying a high voltage alternating current or periodic pulse voltage between the unit electrodes to form a discharge field, where an active species, a radical, and an ion are generated to promote reaction and decomposition of gas. In addition, since an electric field is generated between the unit electrodes at this time, when fine powdery dust is passed through the space between two unit electrodes, the fine powdery dust is drawn onto one of the two unit electrodes. Thus, since the aforementioned dust-collecting electrode can draw fine powdery dust onto a unit electrode constituting a dust-collecting electrode and can directly decompose the fine powdery dust by the silent discharge between the dust-collecting electrodes, re-dispersion of the fine powdery dust can be avoided.

In addition, a secondary effect of treating harmful components, for example, highly toxic dioxin such as polychlorinated dibenzo-p-dioxin (PCDD) and polychlorinated dibenzofuran (PCDF) contained in the gas besides fine powdery dust such as dust can be expected by passing the gas discharged from various kinds of incinerators and the like through the aforementioned discharge field, and an electrostatic dust collector provided with such a discharge electrode has been disclosed (see, e.g., non-Patent Document 1).

Such a discharge electrode is exemplified, as shown in FIG. 7, by a discharge electrode 31 provided with a dielectric body 32 constituted by a ceramic and the like, a conductive layer 34 disposed inside the dielectric body 32, and an electric wiring 33.

A discharge electrode 31 shown in FIG. 7 can cause discharge in the vicinity of the surface of the dielectric body 32 by applying voltage between the conductive layer 34 and the electric wiring 33. The state of the discharge generated in the vicinity of the surface of the dielectric body 32 is called creeping discharge, and fine powdery dust can be decomposed by passing the fine powdery dust in the creeping discharge.

Non-Patent Document 1: "Plasma Gas Phase Reaction Engineering" by Shinriki Teii and Shigeru Ono, published by Uchida Rokakuho on Apr. 28, 2004; Page 107

DISCLOSURE OF THE INVENTION

Though electrostatic dust collection of fine powdery dust such as dust is possible since an electric field and silent discharge are caused between unit electrodes as described above in a conventional dust-collecting electrode used for a dust collector where electrostatic dust collection and silent discharge are combined with each other, there is a problem of insufficiently treating fine powdery dust collected on a surface of a unit electrode because energy is input mainly to a space. In addition, in a discharge electrode 31 as shown in FIG. 7, when two or more of discharge electrodes 31 are disposed so as to face each other to form a gap between them, there is a problem of hardly collecting dust electrostatically since an electric field large enough to collect fine powdery dust electrostatically is not caused in the gap.

The present invention has been made in view of the aforementioned problems and aims to provide a dust-collecting electrode which treats fine powdery dust by generating an electric field and silent discharge between unit electrodes facing each other and causing creeping discharge on a surface of at least one of the unit electrodes and which has gas decomposition ability capable of decompose gas effectively due to discharge caused in a gap, and a dust collector using the dust-collecting electrode.

The present invention provides the following dust-collecting electrode and dust-collector.

[1] A dust-collecting electrode having two or more of unit electrodes facing each other, wherein at least one unit electrode of the unit electrodes facing each other comprises: a ceramic dielectric body composed of ceramic, a surface conductor disposed so as to cover at least a part of the surface of the ceramic dielectric body on the side where the one unit electrode and the other unit electrode face each other, and an internal conductive layer disposed inside the ceramic dielectric body and being electrically independent of the surface conductor, the dust-collecting electrode being capable of generating an electric field and silent discharge between the unit electrodes facing each other by applying voltage between the surface conductor of the one unit electrode and the other unit electrode facing the one unit electrode on the side where the surface conductor is disposed and generating creeping discharge on the surface of the one unit electrode by applying voltage between the surface conductor of the unit electrode and the internal conductive layer via the ceramic dielectric body.

[2] A dust-collecting electrode according to the above [1], wherein the surface conductor has a lattice-like structure in the unit electrode having the surface conductor.

[3] A dust-collecting electrode according to the above [2], wherein, in the case that the surface conductor has a lattice-like structure in the unit electrode having the surface conductor, at least a part of a width [of each cell] constituting lattice-like structure is 0.1 to 2 mm, and a ratio of an area of the surface conductor per unit area on a surface of the unit electrode is 50 to 90%.

[4] a dust-collecting electrode according to any one of the above [1] to [3], wherein the one unit electrode having the surface conductor further has a cover film constituted by a metal film disposed so as to cover the surface conductor.

[5] A dust-collecting electrode according to any one of the above [1] to [4], wherein the ceramic dielectric body contains at least one compound selected from the group consisting of aluminum oxide, magnesium oxide, silicon oxide, silicon nitride, aluminum nitride, mullite, spinel, cordierite, magnesium-calcium-titanium-based oxides, barium-titanium-zinc-based oxides, and barium-titanium-based oxides.

[6] A dust-collecting electrode according to any one of the above [1] to [5], wherein the surface conductor contains at least one metal selected from the group consisting of tungsten, molybdenum, manganese, chromium, titanium, zirconium, nickel, iron, silver, copper, platinum, and palladium.

[7] a dust-collecting electrode according to any one of the above [1] to [6], wherein the internal conductive layer contains at least one metal selected from the group consisting of tungsten, molybdenum, manganese, chromium, titanium, zirconium, nickel, iron, silver, copper, platinum, and palladium.

[8] a dust-collecting electrode according to any one of the above [4] to [7], wherein the cover film contains at least one metal selected from the group consisting of nickel, cobalt, chromium, iron, silver, palladium, platinum, and gold.

[9] a dust-collecting electrode according to any one of the above [1] to [8], wherein the other unit electrode facing the one unit electrode comprises: a ceramic dielectric body composed of ceramic, a surface conductor disposed so as to cover at least a part of the surface of the ceramic dielectric body on the side where the one unit electrode and the other unit electrode face each other, and an internal conductive layer disposed inside the ceramic dielectric body and being electrically independent of the surface conductor, the dust-collecting electrode being capable of generating an electric field and silent discharge between the unit electrodes facing each other by applying voltage between the surface conductor of the one unit electrode and the surface conductor of the other unit electrode and generating creeping discharge on the surface of the other unit electrode by applying voltage between the surface conductor of the other unit electrode and the internal conductive layer via the ceramic dielectric body of the other unit electrode.

[10] a dust collector comprising: a dust-collecting electrode according to any one of the above [1] to [9] and a case body having a passage (gas passage) of gas containing fine powdery dust therein; wherein, when the gas is introduced into the gas passage of the case body, the fine powdery dust contained in the gas is electrostatically collected by the electric field generated between the unit electrodes constituting the dust-collecting electrode and facing each other, and the electrostatically collected fine powdery dust can react with the creeping discharge.

[11] a dust collector according to the above [10], wherein at least one pulse power source for applying voltage is further provided on the dust-collecting electrode.

[12] a dust collector according to the above [11], wherein the pulse power source has at least one SI thyristor therein.

a dust-collecting electrode of the present invention can generate an electric field and silent discharge between unit electrodes facing each other and generate creeping discharge on a surface of at least one of the unit electrodes. In addition, since a dust collector of the present invention is provided with the above dust-collecting electrode, gas containing fine powdery dust such as gas discharged from an incinerator can effectively react.

BRIEF DESCRIPTION OF THE DRAWINGS

FIG. 6(*b*) is a cross-sectional view along the A—A line in FIG. 6(*a*).

EXPLANATION OF SYMBOLS

1: dust-collecting electrode, 2: unit electrode (one unit electrode), 3: unit electrode (the other unit electrode), 4: ceramic dielectric body, 5: surface conductor, 6: internal conductive layer, 7: fine powdery dust, 8: gas, 10: electric field, 11: creeping discharge, 12: creeping discharge, 14: ceramic dielectric body (second ceramic dielectric body), 15: surface conductor (second surface conductor), 16: internal conductive layer (second internal conductive layer), 17: cover film, 18: cover film (second cover film), 21: electrostatic dust collector, 22: case body, 23: passage of gas (gas passage), 31: discharge electrode, 32: dielectric body, 33: electric wiring, 34: conductor

BEST MODE FOR CARRYING OUT THE INVENTION

Embodiments of a dust-collecting electrode and a dust collector of the present invention (first and second aspect of the invention) will hereinbelow be described in detail with referring to drawings. However, the present invention should not be construed with limiting to these embodiments, and various changes, modifications, improvements may be added on the basis of knowledge of those skilled in the art as long as they do not deviate from the range of the present invention.

Figure 1:
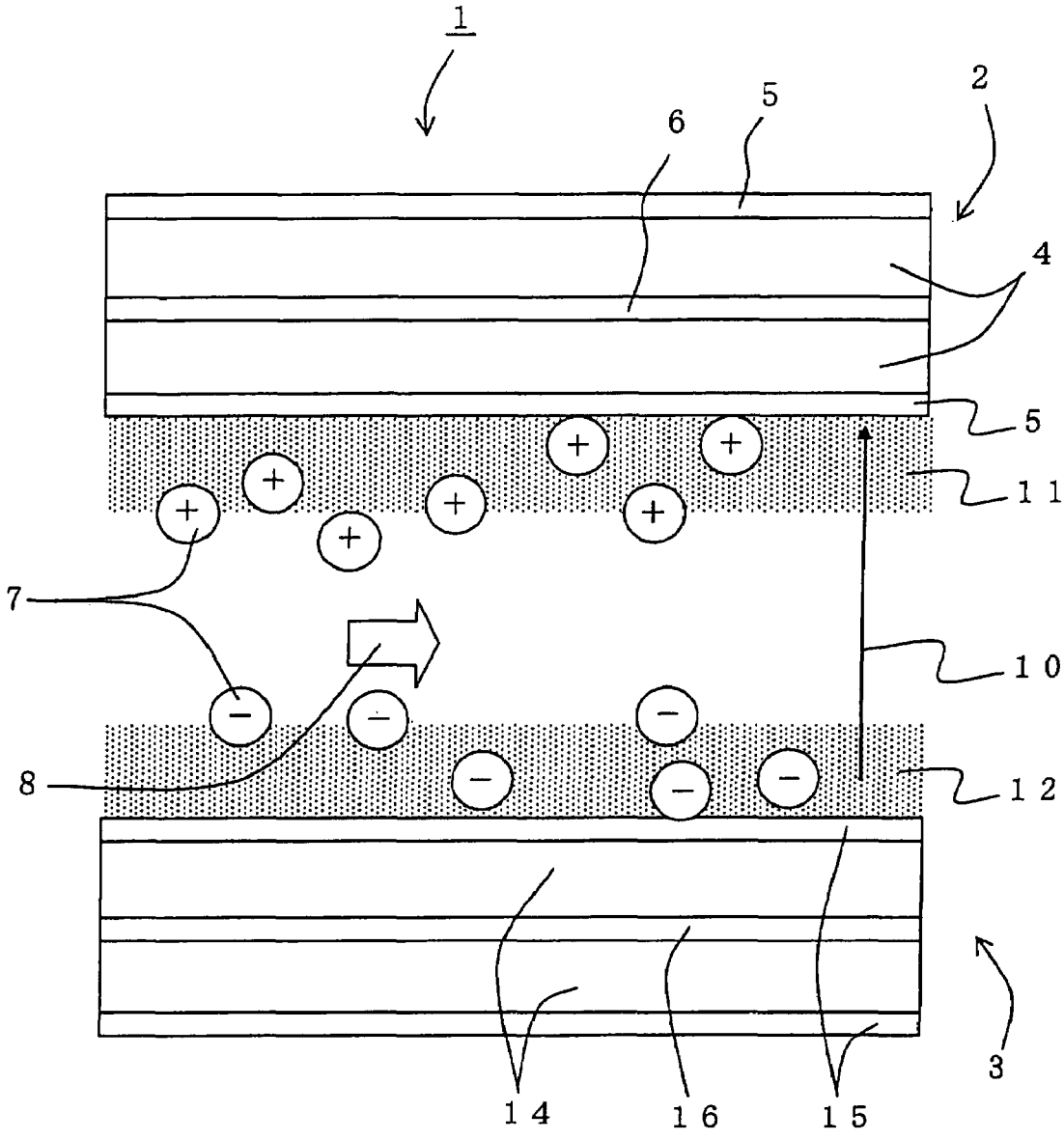
FIG. 1 is an explanatory view schematically showing an embodiment of a dust-collecting electrode of the present invention (first aspect of the invention).

First, an embodiment of a dust-collecting electrode of the present invention (first aspect of the invention) will specifically be described. FIG. 1 is an explanatory view schematically showing an embodiment of a dust-collecting electrode of the present invention (first aspect of the invention). FIG. 1 is a cross-sectional view obtained by cutting a dust-collecting electrode along a plane perpendicular to a surface of a unit electrode. As shown in FIG. 1, the dust-collecting electrode of the present embodiment is a dust-collecting electrode 1 having two or more of unit electrodes facing each other, at least one of the unit electrodes 2 and 3 facing each other has a ceramic dielectric body 4 composed of ceramic, a surface conductor 5 disposed so as to cover at least a part of the surface of the ceramic dielectric body 4 on the side where the one unit electrode 2 and the other unit electrode 3 face each other, and an internal conductive layer 6 disposed inside the ceramic dielectric body 4 and being electrically independent of the surface conductor 5. The dust-collecting electrode 1 of the present embodiment can generate an electric field 10 and silent discharge between the unit electrodes 2 and 3 facing each other by applying voltage between the surface conductor 5 of the one unit electrode 2 and the other unit electrode 3 on the side where the surface conductor 5 is disposed, and generate creeping discharge 11 on the surface of the one unit electrode 2 by applying voltage between the surface conductor 5 of the one unit electrode 2 and the internal conductive layer 6 via the ceramic dielectric body 4.

a dust-collecting electrode 1 of the present embodiment can effectively be used for a dust collector such as an electrostatic dust collector where gas 8 containing fine powdery dust 7 such as carbon fine particle is passed through a gap between the unit electrodes 2 and 3. For example, in the case of passing gas 8 containing fine powdery dust 7 between unit electrodes 2 and 3 of a dust-collecting electrode 1 of the present embodiment, an electric field 10 and silent discharge are generated between the unit electrodes 2 and 3, and fine powdery dust 7 subjected to electric charge is drawn by one of the unit electrodes 2 and 3, and collected by an electrostatic force. The collected fine powdery dust 7 reacts with creeping discharge 11 generated on a surface of the unit electrode 2 and is treated. Though it is less than the creeping discharge 11, the fine powdery dust 7 also reacts with silent discharge generated between the unit electrodes 2 and 3, and is treated.

Figure 7:
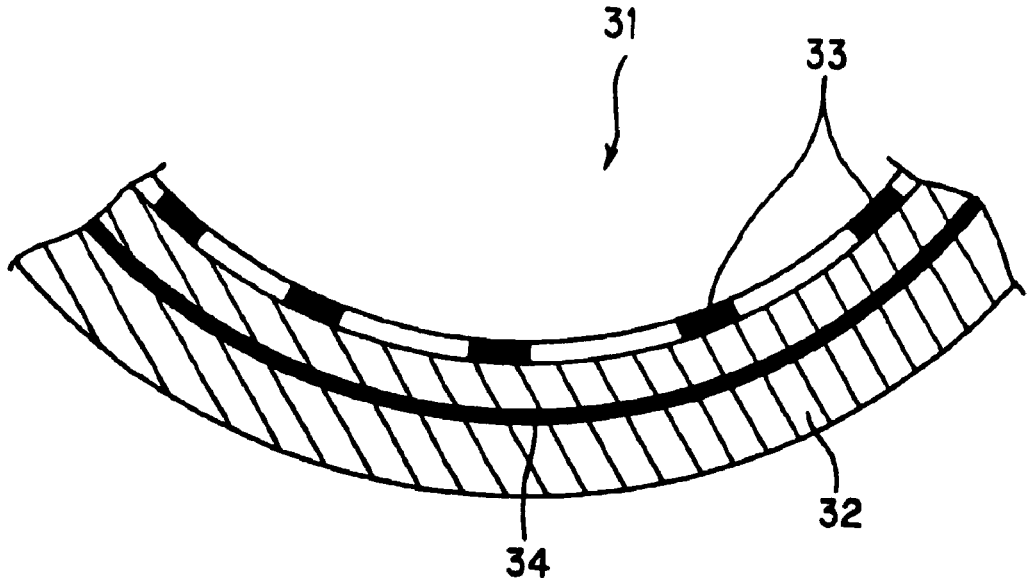
FIG. 7 is an explanatory view schematically showing a conventional dust-collecting electrode.

In a conventional discharge electrode 31 as shown in FIG. 7, fine powdery dust contained in gas cannot be treated unless the gas passes through a region where creeping discharge is generated (hereinbelow sometimes referred to as "creeping discharge-generating region"). However, in a dust collecting electrode 1 of the present embodiment, since the fine powdery dust 7 contained in the gas 8 can be drawn to the creeping discharge-generating region by the electrostatic force generated by the electric field 10, the region other than the creeping discharge-generating region can serve as a passage of gas 8, which enables to enhance reactivity as an electrostatic dust collector or the like and reduce pressure loss in the case that the dust-collecting electrode 1 is used for a dust collector, for example, an electrostatic dust collector. Therefore, the dust-collecting electrode 1 of the present embodiment can suitably be used as a reactor where gas 8 containing predetermined components such as fine powdery dust reacts, for example, an electrostatic dust collector treating gas discharged from a combustion furnace or the like.

As shown in FIG. 1, in the dust-collecting electrode 1 of the present embodiment, the other unit electrode 3 facing the one unit electrode 2 has: a ceramic dielectric body 14 (hereinbelow sometimes referred to as the "second ceramic dielectric body 14") composed of ceramic, a surface conductor 15 (hereinbelow sometimes referred to as the "second surface conductor 15") disposed so as to cover at least a part of the surface of the second ceramic dielectric body 14 on the side where the one unit electrode 2 and the other unit electrode 3 face each other, and an internal conductive layer 16 disposed inside the second ceramic dielectric body 14 and being electrically independent of the second surface conductor 15, and the dust-collecting electrode 1 can generate an electric field 10 and silent discharge between the unit electrodes 2 and 3 facing each other by applying voltage between the surface conductor 5 of the one unit electrode 2 and the second surface conductor 15 of the other unit electrode 3 and generate creeping discharge 12 on the surface of the other unit electrode 3 by applying voltage between the second surface conductor 15 of the other unit electrode 3 and the second internal conductive layer 16 via the second ceramic dielectric body 14 of the other unit electrode 3.

Since creeping discharges 11 and 12 are generated on both the unit electrodes 2 and 3 facing each other, fine powdery dust 7 having either plus or minus electric charge can easily be treated, and thereby reactivity can be enhanced.

Figure 2:
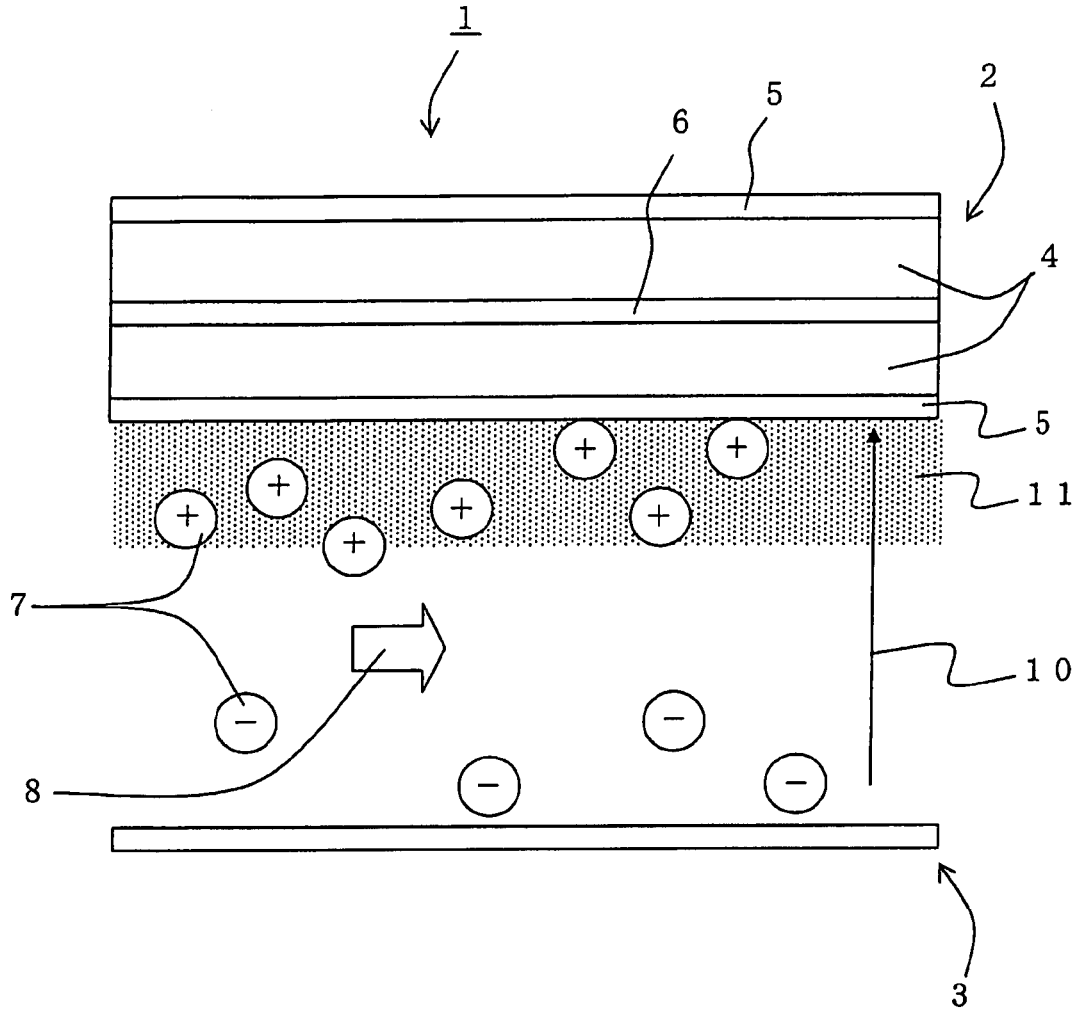
FIG. 2 is an explanatory view schematically showing another embodiment of a dust-collecting electrode of the present invention (first aspect of the invention).

Incidentally, in a dust-collecting electrode 1 of the present embodiment, as long as one unit electrode 2 has the ceramic dielectric body 4, surface conductor 5, and internal conductive layer 6, the constitution of the other unit electrode 3 is not particularly limited as long as it can generate the electric field 10 and the silent discharge between the unit electrode 3 and the surface conductor 5 of the one unit electrode 2, and the other unit electrode 3 may be a conventionally known unit electrode 3 constituted of a conductive substance as the dust-collecting electrode 1 shown in FIG. 2.

Figure 3:
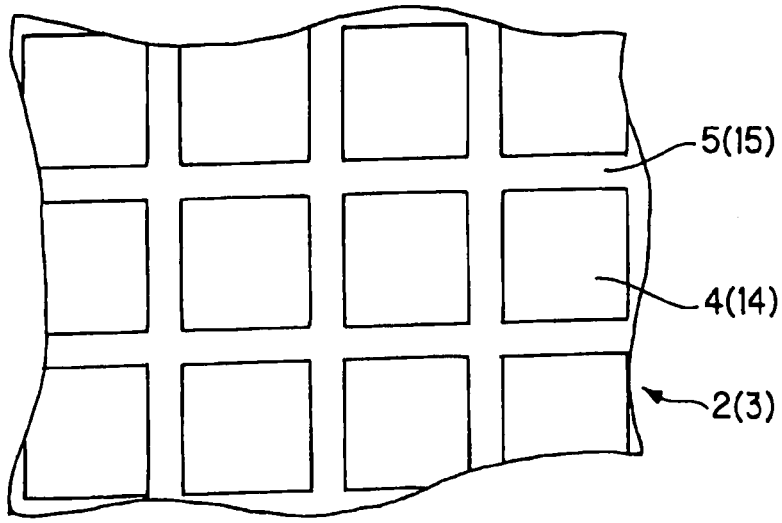
FIG. 3 is a plan view showing an example of a surface conductor of one of the unit electrodes used in an embodiment of a dust-collecting electrode of the present invention (first aspect of the invention).
Figure 4:
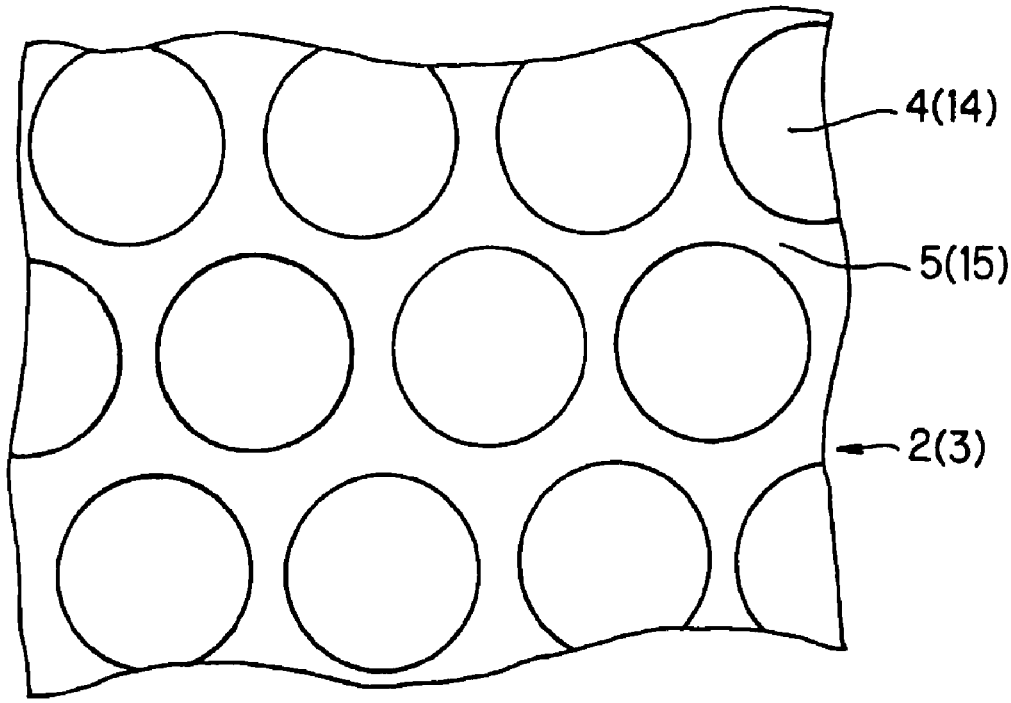
FIG. 4 is a plan view showing another example of a surface conductor of one of the unit electrodes used in an embodiment of a dust-collecting electrode of the present invention (first aspect of the invention).

Here, FIGS. 3 and 4 are plan views showing a surface conductor of one unit electrode used for a dust-collecting electrode of the present embodiment. As shown in FIGS. 3 and 4, in a dust-collecting electrode 1 of the present embodiment (see FIG. 1), it is preferable that the surface conductor 5 of the unit electrode 2 (one unit electrode 2 in FIGS. 3 and 4) having the surface conductor 5 has a lattice-like structure constituted by a polygon having three or more angles, a circle, an oval, or a combination thereof. Thus, by forming the surface conductor 5 in a lattice-like structure, stable creeping discharge 11 (see FIG. 1) can effectively be generated. Incidentally, though the surface conductors 5 having lattice-like structure constituted by a plurality of quadrangles in FIG. 3 and constituted by a plurality of circles in FIG. 4 are shown, the lattice-like structure is not limited to these shapes.

Thus, in the case that the surface conductor 5 of the unit electrode 2 has a lattice-like structure, at least a part of a width [of each cell] constituting lattice-like structure is preferably 0.1 to 2 mm, and a ratio of area of the surface conductor 5 per unit area on the surface of the unit electrode 2 is preferably 50 to 90%. By such a constitution, as shown in FIG. 1, the electric field 10 for collecting fine powdery dust 7 and the creeping discharge 11 for reacting with the collected fine powdery dust 7 are well balanced, and thereby the fine powdery dust 7 can effectively be treated with low power consumption. Incidentally, in the present embodiment, it is further preferable that the narrowest part of the width [of each cell] constituting lattice-like structure is 0.1 to 2 mm.

a shape of the surface conductor 5 of the one unit electrode 2 has been described with referring to FIGS. 3 and 4. As shown in FIG. 1, in the case that the other unit electrode 3 has the second surface conductor 15, it is preferable that a shape of the second surface conductor 15 also has a lattice-like structure in the same manner as the surface conductor 5 of the unit electrode 2. Further, in the case that a shape of the second surface conductor 15 has a lattice-like structure, at least a part of a width [of each cell] constituting lattice-like structure is preferably 0.1 to 2 mm, and a ratio of area of the second surface conductor 15 per unit area on the surface of the other unit electrode 3 is preferably 50 to 90%.

Though there is no particular limitation on a material of the ceramic dielectric body 4 constituting the dust-collecting electrode 1 of the present embodiment as shown in FIG. 1 as long as the material can suitably be used for the dielectric body, it is preferable that the material contains at least one kind of compound selected from the group consisting of aluminum oxide, magnesium oxide, silicon oxide, silicon nitride, aluminum nitride, mullite, spinel, cordierite, magnesium-calcium-titanium based oxide, barium-titanium-zinc based oxide, and barium-titanium based oxide. By containing such a compound, a ceramic dielectric body 4 hardly damaged even if temperature fluctuation of gas discharged from a firing furnace or the like is caused and excellent in thermal shock resistance can be obtained. The ceramic dielectric body 4 used in the present embodiment can be formed using a tape-shaped unfired ceramic formed body, for example, a ceramic green sheet. Alternatively, it may be formed using a sheet obtained by extrusion forming. Further, it is also possible to use a flat plate manufactured by dry press of powder.

Though there is no particular limitation on a surface conductor 5 constituting the dust-collecting electrode 1 of the present embodiment as long as it can generate creeping discharge 11 on a surface of the one unit electrode 2 and generate an electric field 10 and silent discharge between the unit electrodes 2 and 3, it is preferable that the surface conductor 5 contains at least one kind of metal selected from the group consisting of tungsten, molybdenum, manganese, chromium, titanium, zirconium, nickel, iron, silver, copper, platinum, and palladium.

Though there is no particular limitation on a method of disposing the surface conductor 5, it can be formed and disposed, for example, by applying a conductive paste prepared by mixing a powder of a metal mentioned above as a preferable material for the surface conductor 5 with an organic binder and a solvent such as terpineol on a ceramic green sheet which will become a ceramic dielectric body 4. Suitable examples of the application method include screen printing, calender roll method, spraying, electrostatic coating, dipping, knife coater, ink jet printing, chemical vapor deposition, and physical vapor deposition. According to such methods, a surface conductor can be formed easily in a predetermined shape, preferably by applying the paste to make a lattice-like structure, and also a thin surface conductor 5 having an excellently flat and smooth surface can be formed.

Though there is no particular limitation on the internal conductive layer 6 constituting the dust-collecting electrode 1 of the present embodiment as long as it can well generate creeping discharge 11 on a surface of the one unit electrode 2, it preferably contains at least one kind of metal selected from the group consisting of tungsten, molybdenum, manganese, chromium, titanium, zirconium, nickel, iron, silver, copper, platinum, and palladium. In addition, it is preferable that the internal conductive layer 6 is constituted of the same material as that for the surface conductor 5. In addition, the internal conductive layer 6 can easily be formed by being disposed on a ceramic green sheet in the same manner as in the surface conductor 5 and laminated with another ceramic green sheet.

The internal conductive layer 6 is disposed inside the ceramic dielectric body 4 in the state that it is electrically independent of (insulated from) the surface conductor 5 in such a manner that creeping discharge 11 can be generated between the internal conductive layer 6 and the surface conductor 5 via the ceramic dielectric body 4. Incidentally, it is preferable that the internal conductive layer 6 secures an electrical connection with the outside in at least one of the end portions of the ceramic dielectric body 4. For example, the internal conductive layer 6 is disposed in such a manner that it is extended to the outside of the ceramic dielectric body 4 to secure electric conduction with the outside by the extended portion.

In a dust-collecting electrode 1 of the present embodiment, there is no particular limitation on thickness or size of unit electrodes 2 and 3, distance between unit electrodes 2 and 3 facing each other, or the like. But, for example, the unit electrode preferably has a length of a side of 20 to 100 mm, a thickness of 0.5 mm to 10 mm, and a distance (gap) between the unit electrodes of 0.5 mm to 10 mm. In addition, there is no particular limitation on thickness and the like of the surface conductor 5, internal conductive layer 6, and the like. But the thickness of the surface conductor 5 and internal conductive layer 6 are preferably 5 to 20 μm, respectively.

Incidentally, as shown in FIG. 1, in the case that the other unit electrode 3 of the dust-collecting electrode 1 of the present embodiment has the second ceramic dielectric body 14, the second surface conductor 15, and the second internal conductive layer 16, the other unit electrode 3 is preferably constituted in the same manner as the aforementioned one unit electrode 2.

Though two unit electrodes 2 and 3 are shown as the mutually facing unit electrodes 2 and 3 in the dust-collecting electrode 1 shown in FIG. 1, a dust-collecting electrode of the present embodiment may be a dust-collecting electrode constituted in a state that two or more unit electrodes are stacked at predetermined gaps. In the case that two or more unit electrodes are stacked so as to face one another, at least one of the mutually facing unit electrodes may have a ceramic dielectric body, a surface conductor, and an internal conductive layer.

Figure 5:
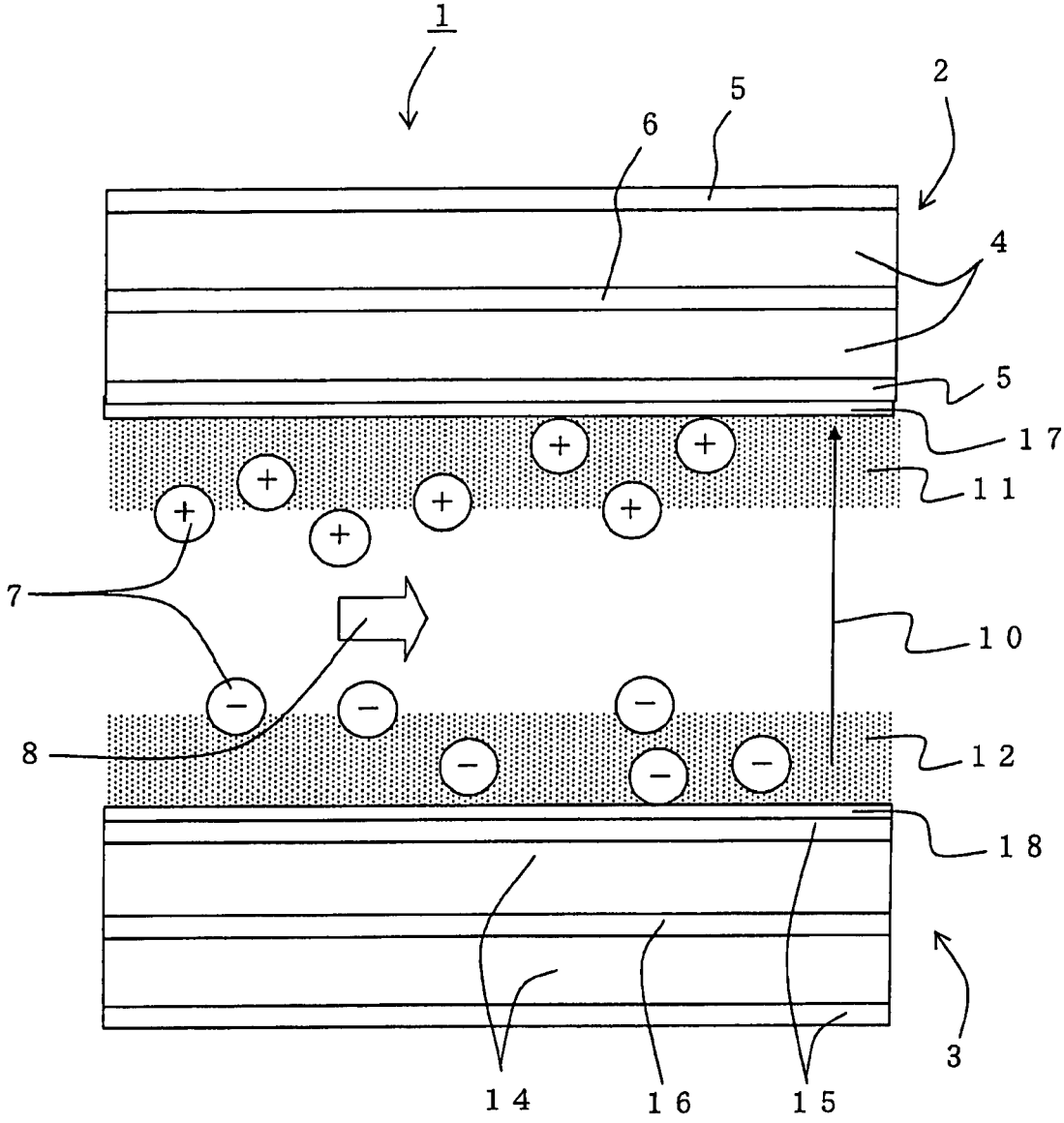
FIG. 5 is an explanatory view schematically showing another embodiment of a dust-collecting electrode of the present invention (first aspect of the invention).

As shown in FIG. 5, in the dust-collecting electrode 1 of the present embodiment, it is preferable that the unit electrode 2 (one unit electrode 2 in FIG. 5) having the surface conductor 5 further has a cover film 17 constituted by a metal film disposed so as to cover the surface conductive layer 5. By such a constitution, even in the case that the gas 8 contains corrosive gas, the gas 8 is not directly brought into contact with the surface conductor 5, thereby effectively inhibit the surface conductor 5 from deteriorating. Incidentally, in the case that the other unit electrodes 3 has the second surface conductor 15, it is preferable that also the other unit electrode 3 further has the cover film 18 (second cover film 18). Moreover, in FIG. 5, each constituent element constituted in the same manner as each element shown in FIG. 1, the same reference numerals are given, and explanation is omitted.

Though there is no particular limitation on material for the cover film 17, it is preferable that the cover film 17 contains at least one metal selected from the group consisting of nickel, cobalt, chromium, iron, silver, palladium, platinum, and gold.

Figure 6A:
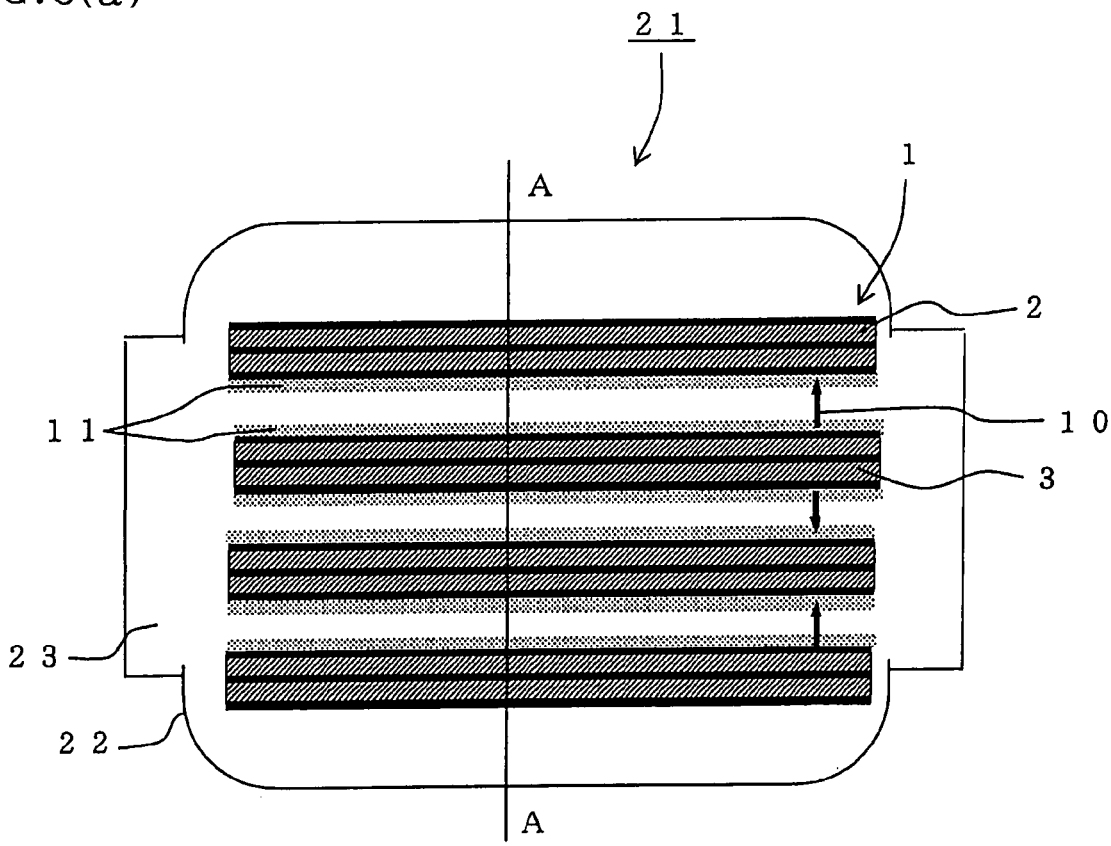
FIG. 6(*a*) is a cross-sectional view obtained by cutting an embodiment of an electrostatic dust collector of the present invention (second aspect of the invention) along a plane perpendicular to a surface of a surface conductor of a dust collector along a gas flow direction.
Figure 6B:
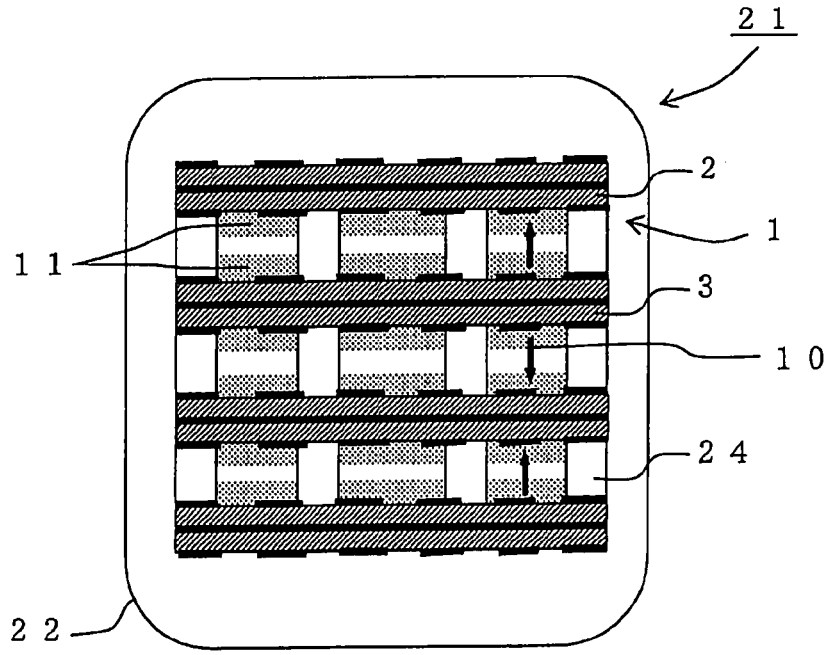

Next, an embodiment of a dust collector of the present invention (second aspect of the invention) will be described more specifically. FIG. 6(*a*) is a cross-sectional view obtained by cutting an embodiment of a dust collector of the present invention along a plane perpendicular to a surface of a surface conductor along a gas flow direction. FIG. 6(*b*) is a cross-sectional view along the A—A line in FIG. 6(*a*).

As shown in FIGS. 6(*a*) and 6(*b*), the dust collector 21 of the present embodiment is provided with a dust-collecting electrode of an embodiment (dust-collecting electrode 1), that is the first aspect of the invention as shown in FIG. 1 and a case body 22 having a passage 23 (gas passage) of gas containing fine powdery dust. And, when the gas containing fine powdery dust is introduced into the gas passage 23 of the case 22, the fine powdery dust contained in the gas is electrostatically collected by the electric field 10 generated between the unit electrodes 2 and 3 constituting the dust-collecting electrode 1 and facing each other. And, the dust collector is a dust collector 21 wherein the fine powdery dust can react with the creeping discharge 11; said fine powdery dust having been contained in a gas introduced into the gas passage 23 of the case body 22 and being electrostatically collected by the electric field 10 generated between the unit electrodes 2 and 3 facing each other to constitute the dust-collecting electrode when the gas containing fine powdery dust is introduced thereinto.

Since the dust collector 21 of the present embodiment can draw fine powdery dust contained in gas to the region where creeping discharge is generated (creeping discharge generation region) by an electrostatic force generated by the electric field 10, gas can be passed through the region including the region other than the creeping discharge generation region. Therefore, the dust collector 21 of the present embodiment has high reactivity and can reduce pressure loss. Therefore, the dust collector 21 of the present embodiment can suitably be used as an electrostatic dust collector for treating gas discharged from, for example, a combustion furnace.

As shown in FIGS. 6(*a*) and 6(*b*), there is no particular limitation on material for the case body 22 constituting the dust collector 21 of the present embodiment. However, for example, the material is preferably austenite-based stainless steel, martensite-based stainless steel, or the like, because the case body may have excellent conductivity and corrosion resistance and easy maintenance.

In addition, the illustration is omitted, the dust collector of the present embodiment may be provided with a power source for applying voltage on the dust-collecting electrode. As for the power source, a conventionally known power source can suitably be employed as long as it can supply an electric current capable of effectively generating creeping discharge. In addition, it is preferable that the aforementioned power source is a pulse power source, and it is more preferable that the power source has at least one SI thyristor therein. By employing such a power source, creeping discharge can be generated more effectively.

In addition, a dust collector of the present embodiment may have a constitution where an electrifying part such as a plug receptacle or the like is provided so that an electric current can be supplied from the outside power source in place of a constitution provided with a power source as described above.

An electric current supplied to a dust-collecting electrode constituting a dust collector can suitably be selected and determined according to intensity of creeping discharge to be generated and an electric field. For example, in the case of disposing a dust collector in a passage of gas discharged from a combustion furnace, it is preferable that an electric current supplied to the dust-collecting electrode is a direct current having a voltage of 1 kV or more, a pulse current having a peak voltage of 1 kV or more and a pulse frequency of 100 or more (100 Hz or more), an alternating current having a peak voltage of 1 kV or more and a frequency of 100 or more (100 Hz or more), or a current obtained by superposing two of them. Such a constitution can generate creeping discharge and an electric field effectively.

EXAMPLES

Next, the present invention will be described in more detail by using examples. However, the present invention is not limited to these examples.

Example

There was manufactured an electrostatic dust collector (dust collector) provided with a dust-collecting electrode where the unit electrodes facing each other had a ceramic dielectric body, a surface conductor disposed so as to cover at least a part of a surface of the ceramic dielectric body, and an internal conductive layer disposed inside the ceramic dielectric body, and an experiment of treating simulated flue gas using the electrostatic dust collector was conducted.

The unit electrode constituting the dust-collecting electrode has outside dimensions of 300 mm×200 mm and a thickness of 2 mm. In addition, the internal conductive layer has dimensions of 290 mm×190 mm, and the surface conductor is mesh-shaped with a mesh wire diameter of 0.5 mm, a mesh spacing of 1 mm, dimensions of a mesh print portion of 290 mm×190 mm.

The dust-collecting electrode was obtained by disposing 60 unit electrodes at 3 mm intervals. As the simulated flue gas, gas obtained by mixing a predetermined fine powdery dust and a substance which simulated dioxin with air was used with a temperature of 200° C., a flow rate of 20 $Nm^3$/min, and a ratio of the fine powdery dust to the air of 16 μg/L. As simulated gas of dioxin, dibenzofuran was used. The electric power was applied to the electrostatic dust collector of the present example by the use of a pulse power source having a S1 thyristor therein with a frequency of 4 kHz and an input power of 6 kW.

The simulated flue gas was sent into the electrostatic dust collector of the present example under the aforementioned conditions to try to remove fine powdery dust in the simulated flue gas, and as a result 75% of the fine powdery dust was electrostatically collected by the electrostatic dust collector, and the gas was purified quickly. In addition, 90% of dibenzofuran which simulated dioxin was decomposed from a dibenzofuran concentration in the gas discharged from the electrostatic dust collector of the present example.

Comparative Example

There was manufactured an electrostatic dust collector provided with a dust-collecting electrode wherein the unit electrodes facing each other have a ceramic dielectric body and an internal conductive layer, and an experiment of treating simulated flue gas was conducted in the same manner as in the aforementioned electrostatic dust collector of the example. In the electrostatic dust collector of the present comparative example, the unit electrode has outside dimensions of 300 mm×200 mm, a thickness of 2 mm, and the internal conductive layer has dimensions of 290 mm×190 mm, and the electrostatic dust collector had the same constitution as the aforementioned electrostatic dust collector of the example except that no surface conductor was employed.

The simulated flue gas was sent into the electrostatic dust collector of the present comparative example under the aforementioned conditions to try to remove fine powdery dust in the simulated flue gas, and as a result only 60% of the fine powdery dust was electrostatically collected by the electrostatic dust collector for purification. After that, the fine powdery dust was gradually accumulated on the dust collecting electrode to show rise in pressure loss, and finally the function was stopped. In addition, though 80% of dibenzofuran which simulated dioxin was decomposed from a dibenzofuran concentration in the gas discharged from the electrostatic dust collector of the present comparative example, dibenzofuran was adsorbed in the fine powdery dust accumulated on the dust-collecting electrode, a decomposition efficiency of dibenzofuran was 80% or less, and the decomposition rate was lower than that of the electrostatic dust collector of the example.

INDUSTRIAL APPLICABILITY

Since a dust-collecting electrode of the present invention can generate an electric field and silent discharge between unit electrodes facing each other and generate creeping discharge on a surface of at least one unit electrodes, for example, in the case of passing gas containing predetermined components such as fine powdery dust between unit electrodes, the fine powdery dust and the like contained in the gas can be drawn to a surface of the unit electrode where creeping discharge is generated. Therefore, it can suitably be used as a dust collector where gas containing predetermined components such as fine powdery dust reacts, for example, an electrostatic dust collector for treating gas discharged from a combustion furnace or the like. In addition, since a dust collector of the present invention is provided with the aforementioned dust-collecting electrode, the dust collector has high reactivity and can suppress accumulation of fine powdery dust on a unit electrode, thereby reducing pressure loss.

The invention claimed is:

1. A dust-collecting electrode having two or more of unit electrodes facing each other, wherein at least one unit electrode of the unit electrodes facing each other comprises: a ceramic dielectric body composed of ceramic, a surface conductor disposed so as to cover at least a part of the surface of the ceramic dielectric body on the side where the one unit electrode and the other unit electrode face each other, and an internal conductive layer disposed inside the ceramic dielectric body and being electrically independent of the surface conductor, the dust-collecting electrode being capable of generating an electric field and silent discharge between the unit electrodes facing each other by applying voltage between the surface conductor of the one unit electrode and the other unit electrode facing the one unit electrode on the side where the surface conductor is disposed and generating creeping discharge on the surface of the one unit electrode and a creeping discharge region between the unit electrodes by applying voltage between the surface conductor of the unit electrode and the internal conductive layer via the ceramic dielectric body, said dust-collecting electrode having a passage for gas containing dust located between the unit electrodes, wherein the dust contained in the gas is electrostatically collected by the electric field in the creeping discharge region.

2. A dust-collecting electrode according to claim 1, wherein the surface conductor has a lattice structure in the unit electrode having the surface conductor.

3. A dust-collecting electrode according to claim 2, wherein, in the case that the surface conductor has a lattice structure in the unit electrode having the surface conductor, at least a part of a width constituting the lattice structure is 0.1 to 2 mm, and a ratio of an area of the surface conductor per unit area on a surface of the unit electrode is 50 to 90%.

4. A dust-collecting electrode according to claim 1, wherein the one unit electrode having the surface conductor further has a cover film constituted by a metal film disposed so as to cover the surface conductor.

5. A dust-collecting electrode according to claim 1, wherein the ceramic dielectric body contains at least one compound selected from the group consisting of aluminum oxide, magnesium oxide, silicon oxide, silicon nitride, aluminum nitride, mullite, spinel, cordierite, magnesium-calcium-titanium-based oxides, barium-titanium-zinc-based oxides, and barium-titanium-based oxides.

6. A dust-collecting electrode according to claim 1, wherein the surface conductor contains at least one metal selected from the group consisting of tungsten, molybdenum, manganese, chromium, titanium, zirconium, nickel, iron, silver, copper, platinum, and palladium.

7. A dust-collecting electrode according to claim 1, wherein the internal conductive layer contains at least one metal selected from the group consisting of tungsten, molybdenum, manganese, chromium, titanium, zirconium, nickel, iron, silver, copper, platinum, and palladium.

8. A dust-collecting electrode according to claim 4, wherein the cover film contains at least one metal selected from the group consisting of nickel, cobalt, chromium, iron, silver, palladium, platinum, and gold.

9. A dust-collecting electrode according to claim 1, wherein the other unit electrode facing the one unit electrode comprises: a ceramic dielectric body composed of ceramic, a surface conductor disposed so as to cover at least a part of the surface of the ceramic dielectric body on the side where the one unit electrode and the other unit electrode face each other, and an internal conductive layer disposed inside the ceramic dielectric body and being electrically independent of the surface conductor, the dust-collecting electrode being capable of generating an electric field and silent discharge between the unit electrodes facing each other by applying voltage between the surface conductor of the one unit electrode and the surface conductor of the other unit electrode and generating creeping discharge on the surface of the other unit electrode by applying voltage between the surface conductor of the other unit electrode and the internal conductive layer via the ceramic dielectric body of the other unit electrode.

10. A dust collector comprising: a dust-collecting electrode having two or more of unit electrodes facing each other, wherein at least one unit electrode of the unit electrodes facing each other comprises: a ceramic dielectric body composed of ceramic, a surface conductor disposed so as to cover at least a part of the surface of the ceramic dielectric body on the side where the one unit electrode and the other unit electrode face each other, and an internal conductive layer disposed inside the ceramic dielectric body and being electrically independent of the surface conductor, the dust-collecting electrode being capable of generating an electric field and silent discharge between the unit electrodes facing each other by applying voltage between the surface conductor of the one unit electrode and the other unit electrode facing the one unit electrode on the side where the surface conductor is disposed and generating creeping discharge on the surface of the one unit electrode and a creeping discharge region between the unit electrodes by applying voltage between the surface conductor of the unit electrode and the internal conductive layer via the ceramic dielectric body, and a case body having a passage for gas containing fine powdery dust therein; wherein, when the gas is introduced into the gas passage of the case body, the fine powdery dust contained in the gas is electrostatically collected by the electric field generated between the unit electrodes constituting the dust-collecting electrode and facing each other, and the electrostatically collected fine powdery dust can react with the creeping discharge in the creeping discharge region.

11. A dust collector according to claim 10, wherein at least one pulse power source for applying voltage is further provided on the dust-collecting electrode.

12. A dust collector according to claim 11, wherein the pulse power source has at least one SI thyristor therein.

* * * * *